US006878182B2

(12) United States Patent
Kruse

(10) Patent No.: US 6,878,182 B2
(45) Date of Patent: Apr. 12, 2005

(54) METHOD OF MAKING TUNGSTEN CARBIDE BASED HARD METALS

(75) Inventor: Olof Kruse, Fagersta (SE)

(73) Assignee: Seco Tools AB, Fagersta (SE)

( * ) Notice: Subject to any disclaimer, the term of this patent is extended or adjusted under 35 U.S.C. 154(b) by 0 days.

(21) Appl. No.: 10/320,619

(22) Filed: Dec. 17, 2002

(65) Prior Publication Data

US 2003/0124017 A1 Jul. 3, 2003

(30) Foreign Application Priority Data

Dec. 19, 2001 (SE) ..... 0104309

(51) Int. Cl.[7] ..... B22F 1/00; B22F 3/00

(52) U.S. Cl. ..... 75/252; 252/358; 252/363.5; 419/18; 419/30; 419/40

(58) Field of Search ..... 419/18, 30, 40; 252/358, 363.5; 75/252

(56) References Cited

U.S. PATENT DOCUMENTS 4,904,411 A * 2/1990 Novich et al. ..... 516/33
5,047,181 A * 9/1991 Occhionero et al. ..... 264/28
6,656,976 B2 * 12/2003 Bergstrom et al. ..... 516/88

FOREIGN PATENT DOCUMENTS

EP 1 153 652 A1 11/2001

OTHER PUBLICATIONS

Laarz et al. "Dispersing WC–Co powders in aqueous media with polyethylenimine", *International Journal of Refractory Metals & Hard Materials* 18 (2000), pp. 281–286.

J. X. Zhang et al., "Aqueous processing of SiC green sheets I; Dispersant," *J. Mater. Res.*, vol. 17, No. 8, Aug. 2002, pp. 2012–2018.

L. R. Oliveira et al., "Deflocculation of $Al_2O_2$–SiC Suspensions," *The American Ceramic Society Bulletin*, vol. 80, No. 2, Feb. 2001, pp. 47–53.

* cited by examiner

*Primary Examiner*—Ngoclan T. Mai
(74) *Attorney, Agent, or Firm*—Burns, Doane, Swecker & Mathis, L.L.P.

(57) ABSTRACT

The present invention relates to economic and environment-friendly slurries and their preparation, handling, and spray drying for the production of cemented carbide based hard metals. The slurry is ethanol-water based and contains metallic and metal carbide raw materials as well as polyethylene glycol (PEG) and a very low concentration of polyethylenimine (PEI). The concentration of PEI is 0.01–<0.1% of the raw material weight. As a result, low-viscous slurries are produced which require less use of ethanol, energy, manpower and equipment time in their preparation, handling, and spray drying.

15 Claims, No Drawings

METHOD OF MAKING TUNGSTEN CARBIDE BASED HARD METALS

FIELD OF THE INVENTION

The present invention relates to economical and environmently-friendly slurries and their preparation, handling, and spray drying of slurries. According to particular embodiments, the invention relates to preparation, handling, and spray-drying of slurries used for the production of tungsten carbide based hard metals.

BACKGROUND OF THE INVENTION

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

Tungsten carbide-based composites, include small grains ($\mu$m-scale) of at least one hard phase in a binder phase. In tungsten carbide based hard metals, the hard phase tungsten carbide (WC) is always present. In addition, other metal carbide compounds with a general composition (Ti,Nb,Ta,W)C may also be included, as well as metal carbonitrides, e.g., Ti(C,N). The binder phase usually contains cobalt (Co). Other binder phase compositions may also be used, e.g., combinations of Co, Ni, and Fe, or Ni and Fe.

One route in the industrial production of tungsten carbide based hard metals includes blending of appropriate proportions of raw materials and additives with alcohol (often ethanol) or water or a mixture thereof. The blend is then wet milled into a slurry. The purpose of the wet milling is to obtain deagglomeration of the raw materials, to homogenize the distribution of all constituents, and, to some extent, to disintegrate individual raw material grains. After completion of the milling process, the obtained slurry is dried and granulated, e.g., in a spray drier. The obtained granulate is then used for uniaxial pressing of green bodies, or for the production of pellets for injection moulding or extrusion.

The processes mentioned above require the use of ethanol and energy, as well as equipment and manpower time. For economical and ecological reasons, it would be desirable to reduce these usages.

The paper "Dispersing WC-Co powders in aqueous media with polyethylenimine" (E. Laarz and L. Bergström, International Journal of Refractory Metals & Hard Materials, 18, 2000, p 281–286) describes the effect of a cationic polyelectrolyte-polyethylenimine, PEI, in slurries of tungsten carbide and cobalt in water. At concentrations above 0.3% with respect to dry powder weight, PEI acts as a dispersant.

EP-A-1153652 relates to the use of PEI in the preparation of dispersed suspensions of WC and Co in water or water-ethanol mixtures. PEI was reported to have a dispersing effect at concentrations above 0.3% in relation to raw material weight in water based slurries with 3.5 wt % polyethylene glycol (PEG) present. In water-ethanol mixtures, the lowest PEI concentration reported to have a dispersing effect was 0.3 wt % in a slurry of WC, TaC, TiC, TiN, and Co powders in a mixture of 90 wt % ethanol and 10 wt % water. A concentration range of 0.1–10 wt % of a polyethylenimine-based polyelectrolyte was claimed.

SUMMARY OF THE INVENTION

It has now surprisingly been found that an addition of 0.01-<0.1 wt % PEI to slurries containing ethanol, water, PEG, and powdered raw materials for the production of tungsten carbide based hard metals gives a radical decrease in slurry viscosity. The slurries so obtained may hence be more concentrated. Thus, smaller volumes of ethanol-water can be used for both milling and in the subsequent rinsing when emptying the mill. In addition, milling time as well as energy requirement in the subsequent drying of the slurry is decreased. Depending on prime priorities, the decrease in viscosity may also be used solely for decreasing the use of ethanol-water (milling time kept constant) or use of milling time (ethanol-water volume kept constant).

According to one aspect, the present invention provides a method of making cemented carbide bodies based on tungsten carbide and with a binder phase based on Co or combinations of Co, Ni, and Fe, or Ni and Fe by powder metallurgical methods, the method comprising: wet milling in alcohol, water, or a mixture thereof, powder and pressing agent to form a slurry; drying the slurry to form a granulate by spray drying; pressing the granulate to form bodies of desired shape and dimension; and sintering; wherein the slurry is formulated to contain 0.01-<0.1 wt % of a polyethylenimine-based polyelectrolyte.

According to another aspect, the present invention provides a slurry containing components necessary to form a cemented carbide, the slurry with a viscosity suitable for spray drying, the slurry comprising 0.01–0.06 wt % of a polyethylenimine-based polyelectrolyte.

DETAILED DESCRIPTION OF THE INVENTION

The invention relates to the slurries and their preparation, handling, and spray drying of slurries used for the production of tungsten carbide based hard metals. The invention is useful for all conventional grain sizes. However, it is particularly useful for grain sizes of 1–5 $\mu$m. For use in slurries containing WC and Co with up to 1 wt % in total of the raw material weight of TaC, NbC, and TiC, the PEI concentration in relation to raw material weight is 0.02–0.06 wt %, preferably 0.03–0.05 wt %. For use in slurries containing WC and Co with 1–15 wt % in total of the raw material weight of TaC, NbC, TiC, and/or Ti(C,N), the PEI concentration is 0.01–0.05 wt %, preferably 0.02–0.04 wt %. The average molecular weight (Mw) of the PEI is 1000–50000, preferably 10000–30000. More particularly, during milling the standard slurry is comprised of a suspension of 77–88 wt % of powdered raw materials (computed on the combined weight of raw materials and liquid), more preferably 79–86 wt %, in a liquid composed of 70–80 wt % ethanol and water. With PEI present, the milling slurry has 78–89 wt % of powdered raw materials, preferably 80–87 wt %. After emptying and rinsing of the mill, the standard slurry has 65–79 wt % raw materials, preferably 67–77 wt %. With PEI present, this slurry has 67–81 wt % raw materials, preferably 69–79 wt %. In addition to the above-mentioned raw materials, minor amounts of carbon black or tungsten metal may be added in order to control the carbon concentration in the sintered material. In the ethanol used, 4 wt % methyl ethyl ketone (MEK) is included. The PEG concentration is 0.5–3.5% of the powder raw material weight. The average molecular weight of the PEG is 1000–7000.

In addition to the above-mentioned raw materials, other compounds may also be used. For example, in one preferred embodiment, zirconium carbide and/or hafnium carbide may be included.

In addition to hard phases like tungsten carbide and TaC, NbC, and TiC, minor amounts (less than 1 wt %) of chromium carbide and/or vanadium carbide may be added in order to inhibit grain growth during sintering.

EXAMPLE 1

Viscosity measurements were made on a slurry containing raw material for the production of a hard metal. The raw material contained 90.4 wt % WC with a milled grain size (Fisher measurement, FSSS, milling according to ASTM) of about 3.6 μm, 9.0 wt % of Co with a Fisher grain size of about 2.0 μm, and 0.6 wt % of (Ta,Nb)C (metal weight ratio 90/10) with a Fisher grain size of about 2.3 μm. In addition, polyethylene glycol (PEG 3400) was present in a concentration of 2.1% of the raw material weight. The liquid phase in the slurry contained a mixture of ethanol (75 wt %) and water. The weight ratio between raw material and liquid phase was 76/24. A viscosity measurement was made at room temperature using a Contraves viscometer (1814, TVB) with continuous agitation of the slurry. A 30 wt % water solution of PEI (delivered by Sigma-Aldrich Sweden, product no. 40,872-7) with average molecular weight 25,000 was added into the slurry which was kept in a beaker during measurements. Before adding the PEI solution, the measured viscosity was 23 (arbitrary units specific for the equipment). Upon adding PEI solution, the viscosity value gradually decreased to 15 units at a concentration of 0.04 wt % PEI. Further adding of PEI solution did not result in a further decrease of the viscosity.

EXAMPLE 2

Viscosity measurements as described above were made on a slurry as described above, where the used PEG had an average molecular weight of 5400–6600 (PEG 6000). Before adding the PEI solution, the measured viscosity was 31 units. Upon adding PEI solution, the viscosity gradually decreased to 16 units at a concentration of 0.04 wt % PEI. Further adding of PEI solution did not result in a further decrease of the viscosity.

EXAMPLE 3

Viscosity measurements as described above were made on a slurry containing raw material for the production of hard metal. The raw material contained 80.7 wt % WC as described in Example 1, 6.3 wt % Co as described in Example 1, 5.9 wt % (Ta,Nb)C (metal weight ratio 63/37) with a Fisher grain size of about 2.6 μm, 4.3 wt % (Ti,W)C (carbide weight ratio 50/50) with a Fisher grain size of about 4.2 μm, and 0.3 wt % Ti(C,N) with a C/N weight ratio 67/33 and a Fisher grain size of about 3.2 μm. In addition, polyethylene glycol (PEG 3400 and PEG 1500) was present in concentrations of 1.8 and 0.4% of the raw material weight, respectively. The liquid phase in the slurry contained a mixture of ethanol (75 wt %) and water. The weight ratio between raw material and liquid phase was 76/24. Before adding the PEI solution, the measured viscosity was 32 units. Upon adding PEI solution, the viscosity gradually decreased to 15 units at a concentration of 0.03 wt % PEI. Further adding of PEI solution resulted only in a minor decrease of viscosity.

EXAMPLE 4

A test in full-scale production was made as follows. A batch of raw materials for the production of hard metal as described in Example 1 was loaded into a ball mill together with PEG and ethanol-water liquid as specified in Example 1. Into the mill, a 30 wt % water solution of PEI was added so that the PEI concentration amounted to 0.04% with respect to the raw material weight. The added liquid volume and milling time were reduced by 10 and 20%, respectively, with respect to standard values. After milling, viscosity was measured on a slurry sample directly from the mill. The obtained value was 94 units. The corresponding value for a slurry obtained from the same raw materials by standard procedure, i.e., standard liquid volume and standard milling time, was >100 units (off scale). The low viscosity facilitated emptying of the ball mill; the volume of ethanol-water used for rinsing could hence be reduced by 10%. The total volume of the slurry, with rinsing liquid added, was therefore decreased by 8%. The viscosity of this slurry was 21 units whereas the value for the corresponding standard slurry was 30 units. The smaller volume resulted in a reduction of the run time in the following spray drying by 9%. The resulting granules as well as the hard metal obtained after sintering were of standard quality.

While the present invention has been described by reference to the above-mentioned embodiments, certain modifications and variations will be evident to those of ordinary skill in the art. Therefore, the present invention is limited only by the scope and spirit of the appended claims.

I claim:

1. A method of making cemented carbide bodies based on tungsten carbide and with a binder phase based on Co or combinations of Co, Ni, and Fe, or Ni and Fe by powder metallurgical methods, the method comprising: wet milling in alcohol, water, or a mixture thereof, powder and pressing agent to form a slurry; drying the slurry to form a granulate by spray drying; pressing the granulate to form bodies of desired shape and dimension; and sintering; wherein the slurry is formulated to contain 0.02–0.06 wt % of a polyethylenimine-based polyelectrolyte to the cemented carbide slurry containing WC and Co with up to 1 wt % in total of the raw material weight comprising TaC, NbC, TiC, or mixtures thereof.

2. A method of making cemented carbide bodies based on tungsten carbide and with a binder phase based on Co or combinations of Co, Ni, and Fe, or Ni and Fe by powder metallurgical methods, the method comprising: wet milling in alcohol, water, or a mixture thereof, powder and pressing agent to form a slurry: drying the slurry to form a granulate by spray drying: pressing the granulate to form bodies of desired shape and dimension: and sintering: wherein 0.01–0.05 wt % of a polyethylenimine-based polyelectrolyte is added to a cemented carbide slurry containing WC and Co with 1–15 wt % in total of the raw material weight of TaC, NbC, and TiC.

3. The method according to claim 1, wherein the average molecular weight (Mw) of the polyethylenimine-based polyelectrolyte is 1000 to 50000.

4. The method according to claim 3, wherein the average molecular weight (Mw) of the polyethylenimine-based polyelectrolyte is 10000 to 30000.

5. The method of claim 1, wherein the slurry further comprises a pressing agent of polyethylene glycol.

6. A slurry containing components necessary to form a cemented carbide, the slurry with a viscosity suitable for spray drying, the slurry comprising 0.01–0.06 wt % of a polyethylenimine-based polyelectrolyte.

7. The slurry according to claim 6, comprising 0.02–0.06 wt % of a polyethylenimine-based polyelectrolyte, WC, and Co, with up to 1 wt % in total of the raw material weight of TaC, NbC, TiC, or mixtures thereof.

8. The slurry according to claim 6, comprising 0.01–0.05 wt % of a polyethylenimine-based polyelectrolyte and WC and Co with 1–15 wt % in total of the raw material weight of TaC, NbC, TiC, or mixtures thereof.

9. The slurry according to claim 6, wherein the average molecular weight (Mw) of the polyethylenimine-based polyelectrolyte is 1000 to 50000.

10. The slurry according to claim 9, wherein the average molecular weight (Mw) of the polyethylenimine-based polyelectrolyte is 10000 to 30000.

11. The slurry according to claim 6, further comprising a pressing agent.

12. The slurry according to claim 11, wherein the pressing agent comprises polyethylene glycol.

13. The method according to claim 2, wherein the average molecular weight (Mw) of the polyethylenimine-based polyelectrolyte is 1000 to 50000.

14. The method according to claim 13, wherein the average molecular weight (Mw) of the polyethylenimine-based polyelectrolyte is 10000 to 30000.

15. The method of claim 2, wherein the slurry further comprises a pressing agent of polyethylene glycol.

* * * * *